US005676540A

United States Patent [19]

Williams et al.

[11] Patent Number: 5,676,540

[45] Date of Patent: Oct. 14, 1997

[54] FLUE WALLS USING INTERLOCKING BRICKS

[75] Inventors: Alfred T. Williams, Newburgh; Dennis J. Haines, Rockport; Robert F. Corcoran, Newburgh; R. Kelly McClara, Evansville; Timothy W. Kempf, Newburgh, all of Ind.

[73] Assignee: Aluminum Company of America, Pittsburg, Pa.

[21] Appl. No.: 618,233

[22] Filed: Mar. 19, 1996

[51] Int. Cl.[6] ..... F27D 1/00

[52] U.S. Cl. ..... 432/247; 432/192; 432/249

[58] Field of Search ..... 110/322, 323, 110/324, 835, 336, 337, 338; 432/247, 249, 252, 192; 52/604, 605, 607, 612, 592.6, 561

[56] References Cited

U.S. PATENT DOCUMENTS

| | | | |
|---|---|---|---|
| 915,195 | 3/1909 | Lemb | 110/338 |
| 1,984,393 | 12/1934 | Brown | 52/561 |
| 1,992,785 | 2/1935 | Steuer | 52/605 |
| 4,990,116 | 2/1991 | Chen | 52/592.6 |
| 5,137,603 | 8/1992 | Arthur, Jr. et al. | 432/247 |
| 5,277,580 | 1/1994 | Miskolczi, Jr. | 110/336 |

*Primary Examiner*—Henry A. Bennett
*Assistant Examiner*—Jiping Lu
*Attorney, Agent, or Firm*—Elroy Strickland; Tracey D. Beiriger

[57] ABSTRACT

A refractory brick and system of bricks for constructing flue walls of a ring furnace. The brick and the bricks of the system have opposed sides and upper and lower surfaces when disposed in a vertical wall structure, with one of the surfaces having at least one crosswise groove while the other surface has a corresponding crosswise tongue for seating in the groove of an adjacent brick, the tongues and grooves terminating short of the ends or sides of the brick when the bricks are disposed in a vertical wall structure. The crosswise tongues and grooves have rounded configurations sized to mate with bricks having the same tongue and groove configurations when a plurality of such bricks are stacked one upon the other in constructing a vertical wall.

7 Claims, 9 Drawing Sheets

FLUE WALLS USING INTERLOCKING BRICKS

BACKGROUND OF THE INVENTION

Figure 1:
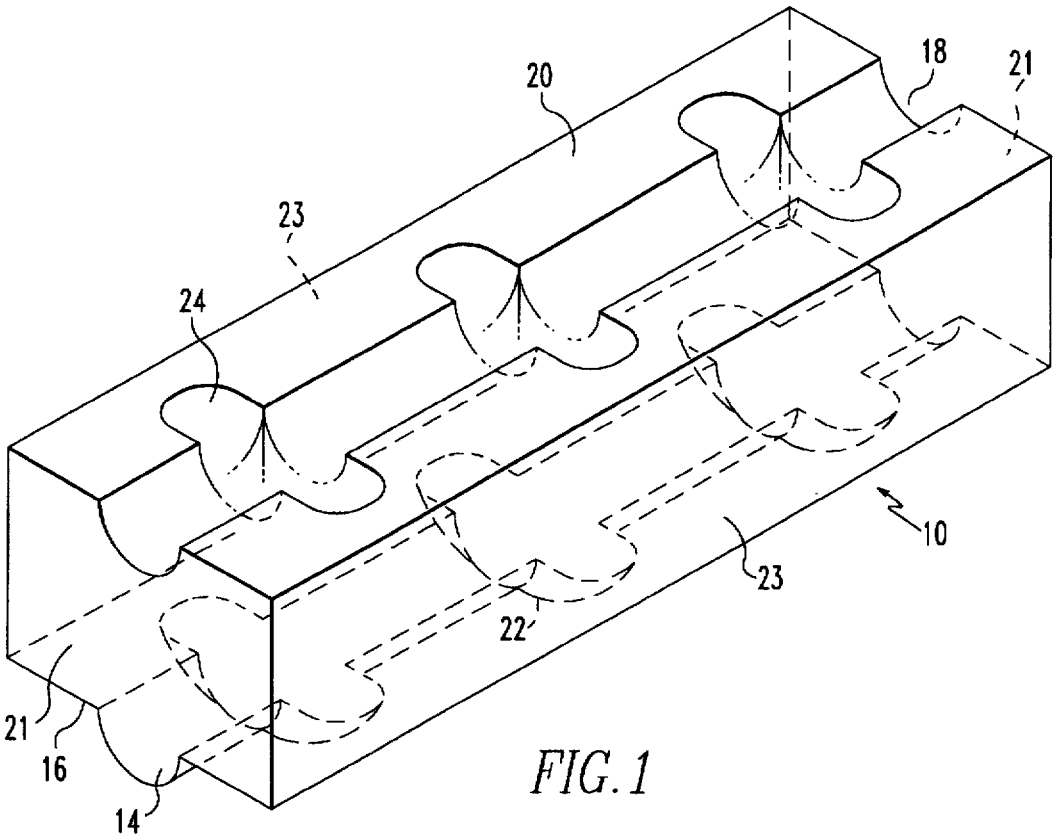

The present invention relates generally to ring faces for baking carbon anodes employed in making aluminum metal, and particularly to flue walls made of interlocking refractory bricks and a system of bricks that have crosswise tongue and groove configurations. Such configurations provide interlocks that maintain the stability and integrity of a flue during heating and cooling cycles in a ring furnace. The brick configurations also permit off-site dry construction of a flue and transport of the entire flue to and into a ring furnace after the bricks of the old flue are removed.

The subject interlocking system is somewhat similar to "waffle" bricks used in construction of headwalls of ring furnaces in that the bricks do not permit communication outside of the write configuration.

A ring furnace includes multiple flues each comprising a pair of spaced vertical walls constructed of refractory brick material. Extending between the confronting surfaces of the walls of the flue are a number of ties and baffles, also constructed of refractory brick. The tie brick tie the flue walls together and the baffles direct a flow of a combustible gas mixture in a predetermined path through the flues which provide heat for baking green carbon anodes stacked in pits located between the flues. The flue walls cycle through temperature changes, as the green carbon anodes are placed in the pits, heated and baked, and then removed from the pits. The pits and flues cool down when combustion in the flues is cycled off before the baked anodes are removed.

The cycles of temperature changes cause the bricks of the flue walls to expand and contract. This creates gaps between the bricks such that granular packing material used in the pits (and located around the anodes) enters and is trapped in such gaps. After a period of time of expansion and contraction, the accumulation of packing material between the bricks eliminates the amount of clearance allowed for expansion between adjoining bricks. Longitudinal expansion of the bricks pushes the bricks towards and into headwalls located between adjacent flues, and the bricks then bow into the pit space; flue life is thereby shortened.

Flue brick presently used in ring furnaces designated as "standard" has a curvilinear tongue and groove interlocking arrangement running the length of each brick. This type of brick is discussed in column three of U.S. Pat. No. 4,021,905 to Benton et al. As can be ascertained from the disclosure of the Benton et al patent, bowing of flue walls with standard type brick is a problem, which Benton et al correct by use of jacks to force the bowed walls back into place. Benton et al's jack is designed, according to the text of the patent (column 4), to eliminate as quickly and economically as possible the bow and collapse of a wall, as such a bow restricts the flow of gases through the flue and threatens the integrity of the entire wall.

A modification of the standard type brick was made by the A.P. Green Company in Mexico, Missouri. This company manufactured a crosswise tongue and groove arrangement, with the crosswise tongue and groove extending the full width of the bricks. This type of crosswise tongue and groove arrangement presents opportunities for communication between the flue combustion chamber and the anode pit chamber. It is imperative, however, that the two chambers be isolated from each other for efficient operation of gas flow in the flues for the heating and baking process.

SUMMARY OF THE INVENTION

The present invention goes a long way toward preventing bowing and collapsing of flue walls. This is accomplished by use of an interlocking brick system comprised of a multiple number of rectangular brick shapes having crosswise tongues and grooves providing mating surfaces. A variety of brick sizes and shapes are required in constructing a flue wall, as the wall itself is a large, deep and rather complicated structure requiring accommodation of a peephole, exhaust and gas entry port blocks and openings that extend to the bottom regions of ring furnaces. The depth of a ring furnace is such that nearly sixty courses of bricks are required in constructing flue walls.

The tongues and grooves of the subject bricks extend both lengthwise of adjoining brick surfaces and crosswise of such surfaces. The crosswise tongues and grooves, in addition, do not extend the full width of the main rectangular brick of the flue wall so that when a flue wall is constructed of a single row of such bricks, no communication is provided between the anode pit and the flue combustion chamber by virtue of such crosswise tongues and grooves.

The tongues and grooves are uniformly sized and consistently located in mating or joining surfaces of each brick so that the bricks are quickly handled in constructing flue walls.

The subject interlock system restricts outward growth of the flue wall and restricts the amount of packing material that might enter any gaps occurring between adjoining bricks. By containing the crosswise tongues and grooves within the mating faces of adjoining bricks, the integrity of the flue wall is maintained and packing material does not easily enter between the bricks. Further, combustion gases are confined in the flues to make the heating process more efficient; the interlocking bricks provide a stronger, longer lasting flue.

THE DRAWINGS

Figure 2:
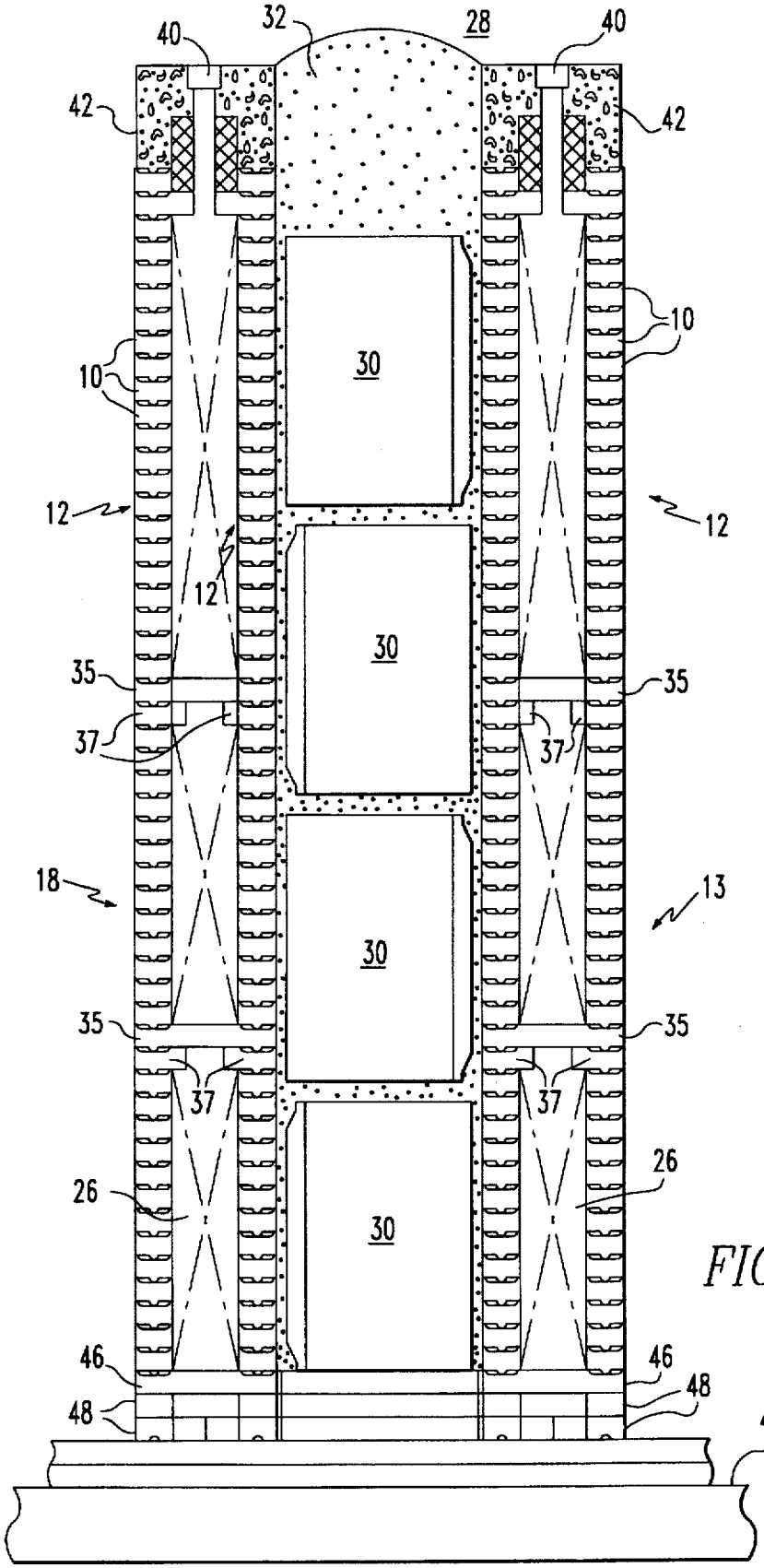
Figure 3:
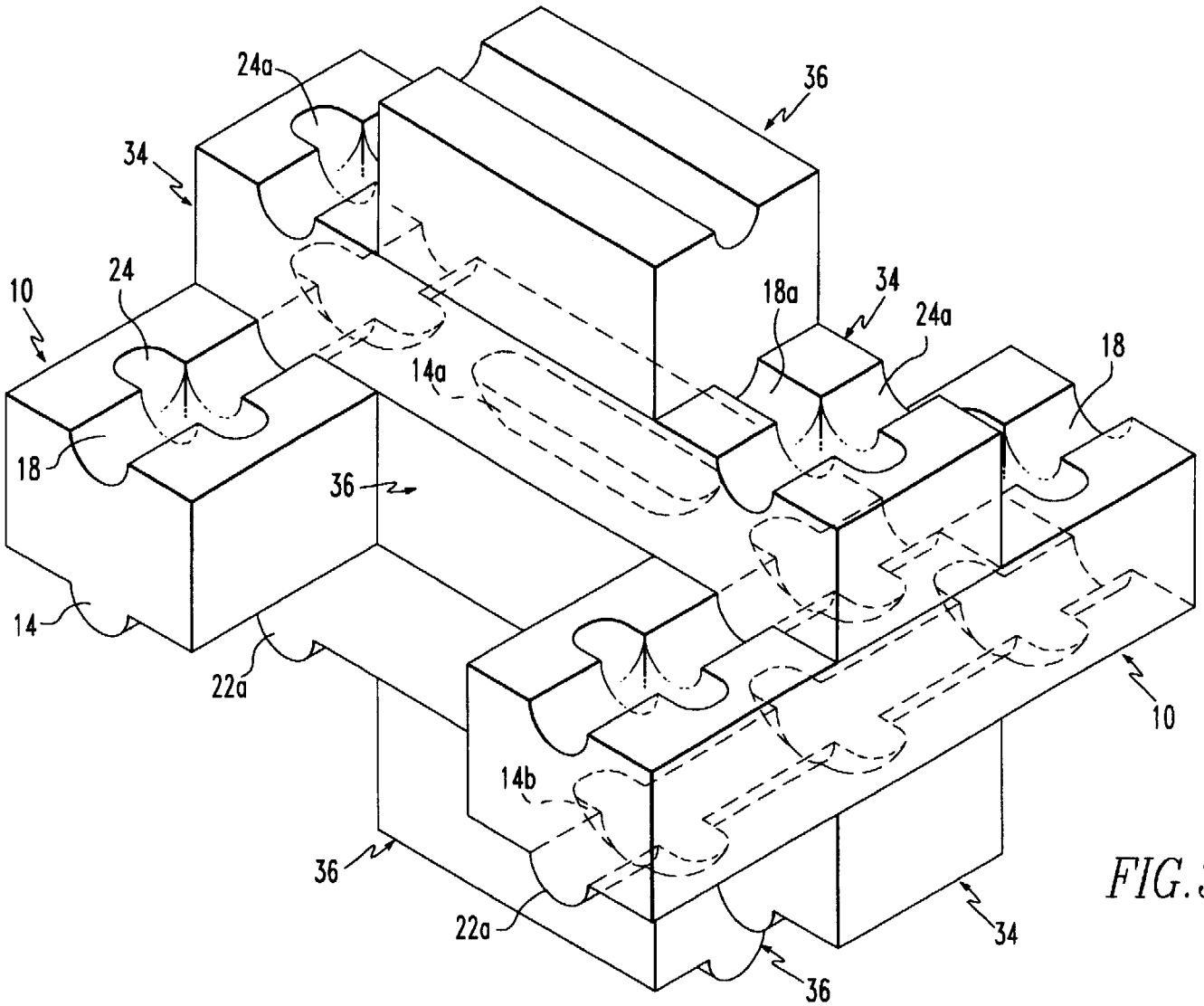
Figure 4:
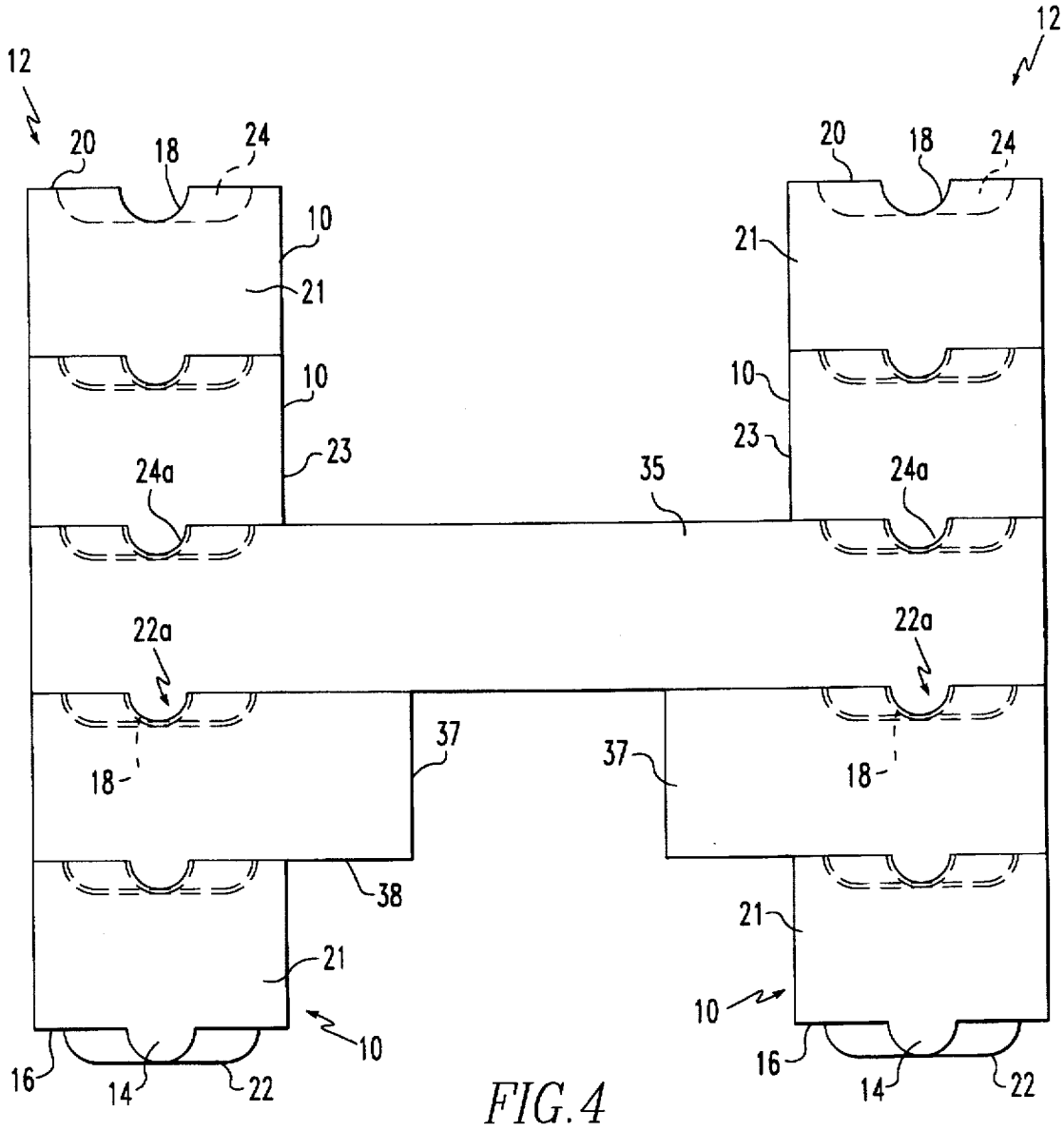
Figure 5:
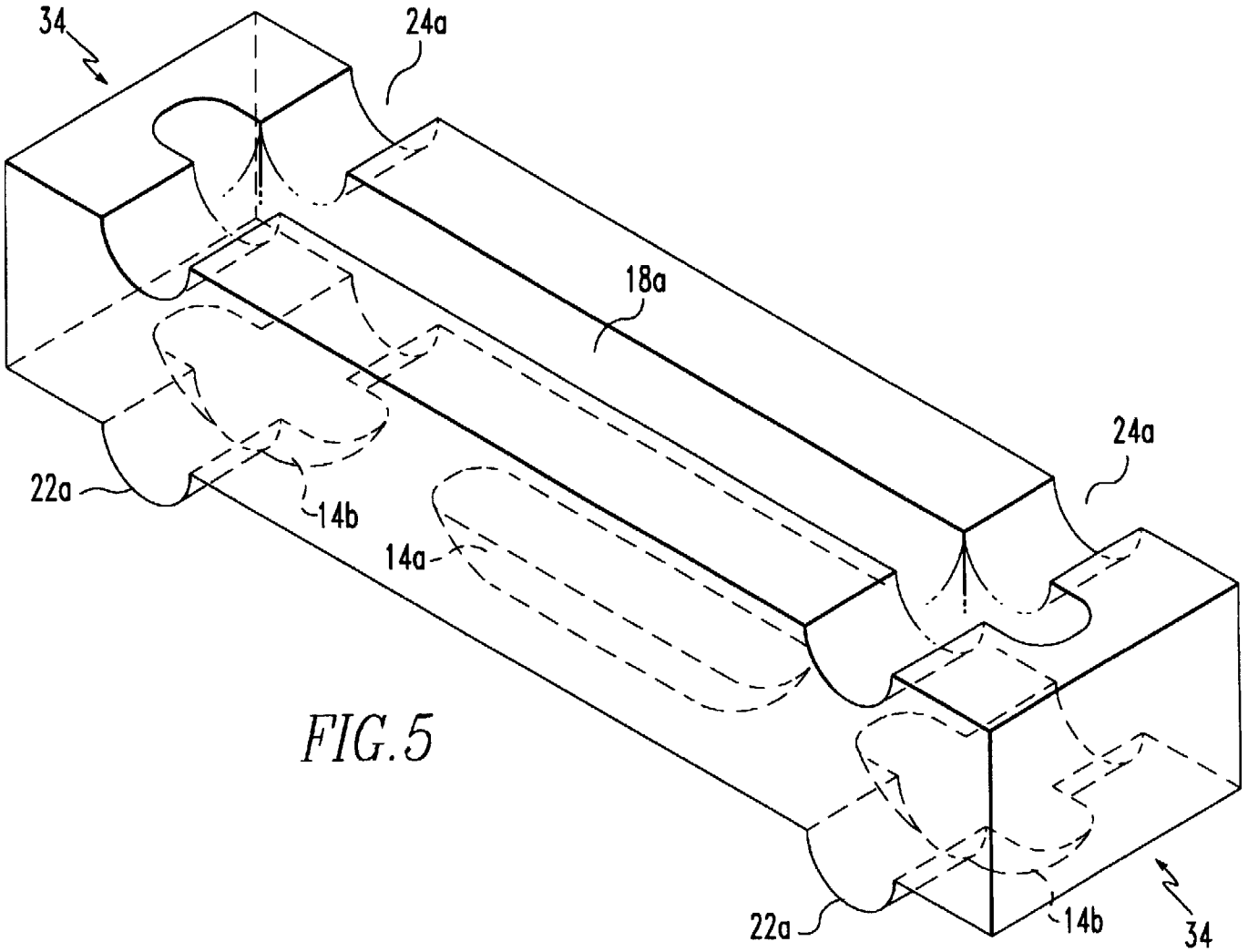
Figure 6A:
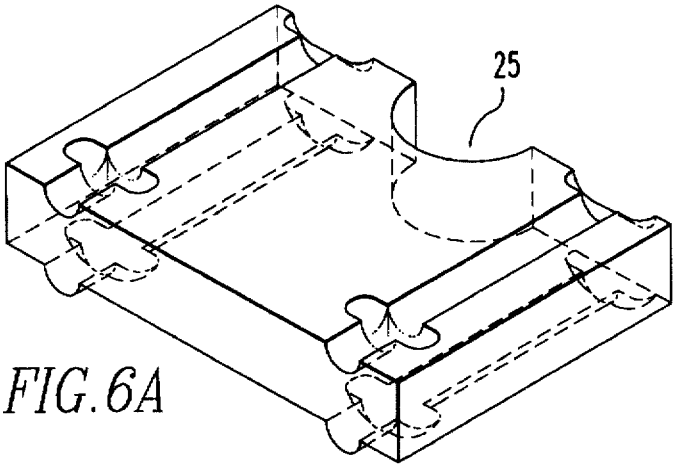
Figure 6B:
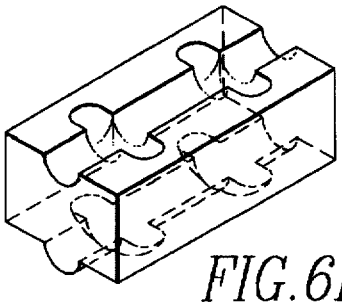
Figure 6C:
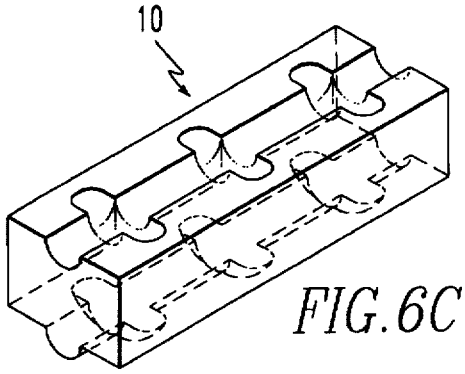
Figure 6D:
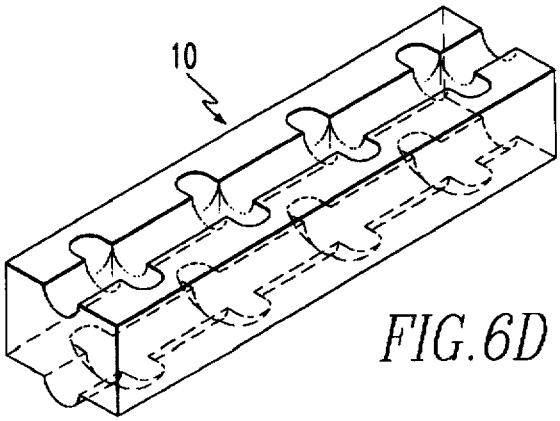
Figure 6E:
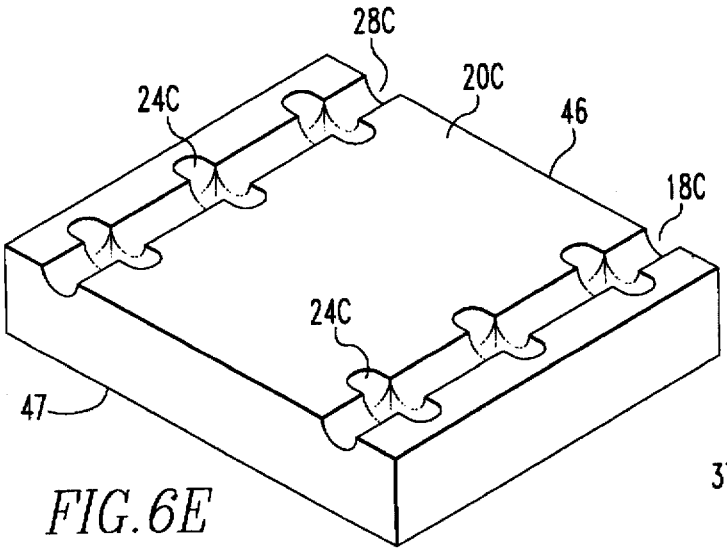
Figure 6F:
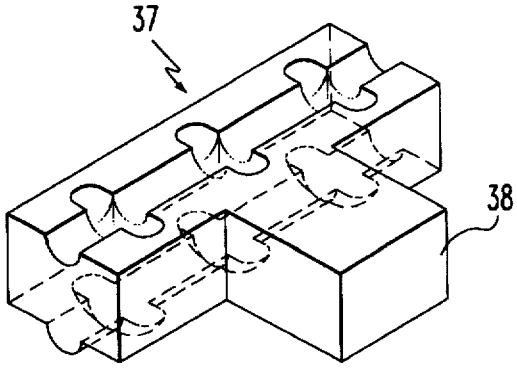
Figure 6G:
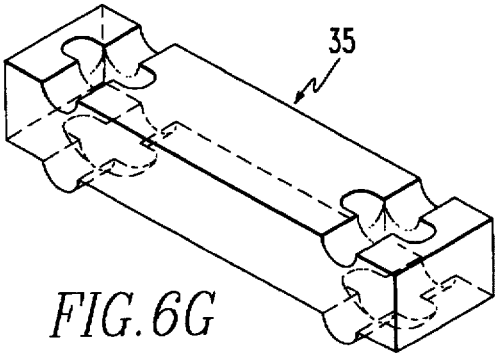
Figure 6H:
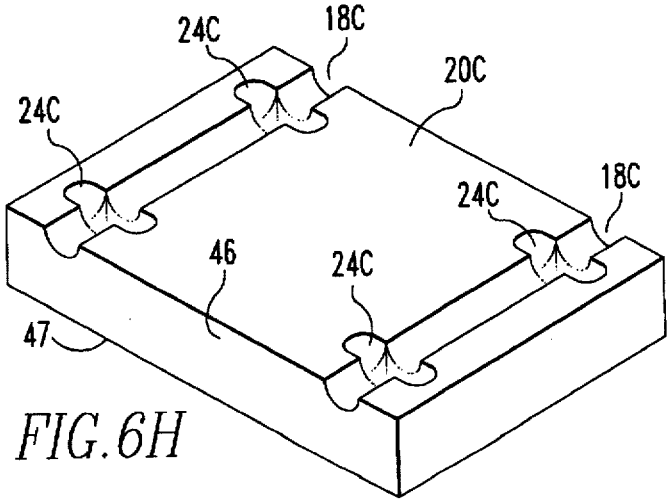
Figure 6I:
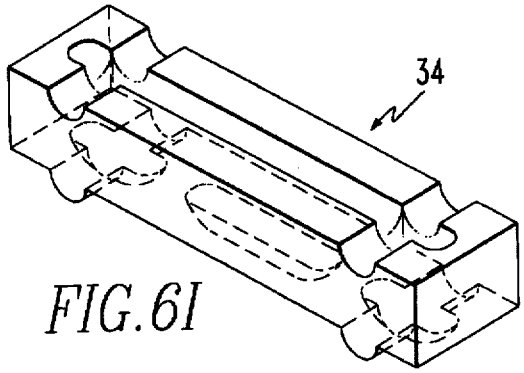
Figure 6J:
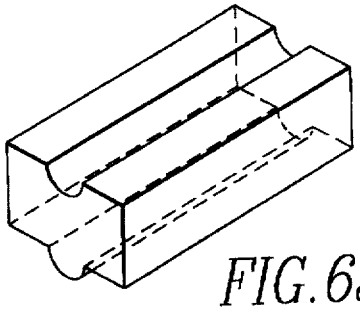
Figure 6K:
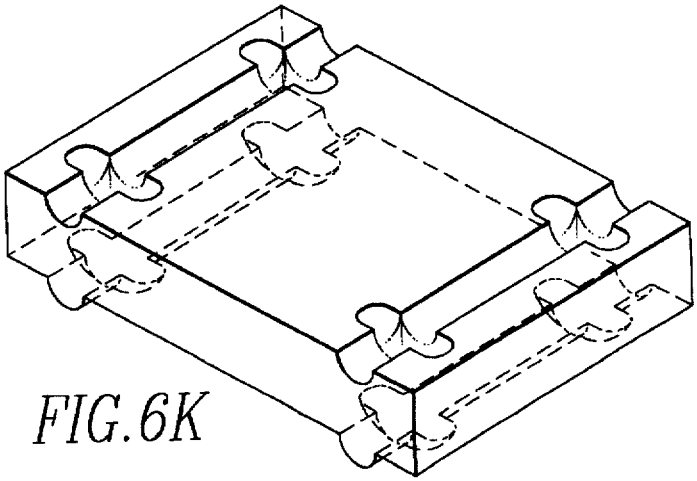
Figure 7:
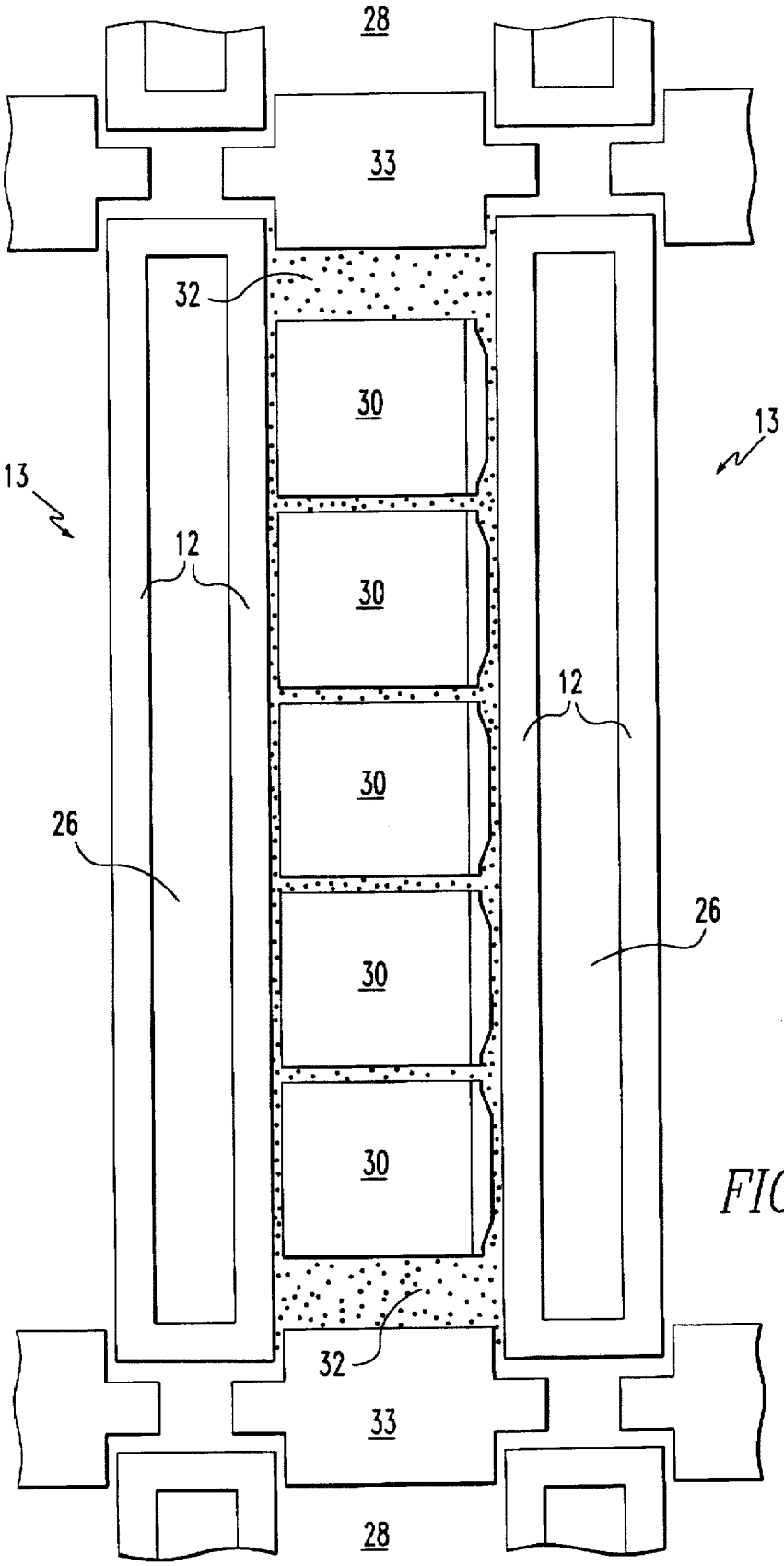

The invention, along with its objectives and advantages, will be better understood from consideration of the following detailed description and the accompanying drawings in which:

FIG. 1 is an isometric view of a brick of the invention preferably having a length of 13½ inches and 4½ inches in width, FIG. 2 is a vertical section of a ring furnace showing parallel flues and an anode pit, FIG. 3 is an isometric view of a partial baffle construction for a combustion chamber flue, the construction showing two baffle bricks of the invention eighteen inches long and four and one-half inches in width in combination with "filler" bricks, FIG. 4 is an elevation view of a tie brick of the invention, and two ledge bricks of the invention, FIG. 5 is an isometric view of a baffle brick of the invention, FIGS. 6A through K show brick shapes of the flue wall interlocking system of the invention, and FIG. 7 is a somewhat diagrammatic plan view of opposed flues, an anode pit between the flues and two headwalls located at the ends of the flues and pit.

PREFERRED EMBODIMENT

Referring now to the drawings, FIG. 1 thereof shows a main rectangular brick 10 of the invention employed in constructing flue walls 12 of a ring furnace 13 (FIGS. 2 and 5). The brick has a central, elongated, longitudinally extending tongue 14 on one surface 16 and a corresponding elongated longitudinal groove 18 provided in a parallel opposed face 20 of the brick. When constructing a vertical wall, 16 and 20 provide lower and upper surfaces. Preferably, the longitudinal tongue and groove extend the full length of the brick structure, i.e., to parallel end surfaces 21, as shown in FIG. 1. This is not the case for the "tie" bricks of FIG. 4 and certain other bricks (FIG. 6) used in constructing a flue wall, as explained below.

Extending crosswise of the longitudinal tongue and groove 14 and 18 of brick 10 are corresponding tongues and grooves 22 and 24. The ends of the crosswise tongues and grooves 22 and 24 terminate short of parallel side faces 23 of the bricks.

In addition, the surfaces of tongues 14 and 22, and of grooves 18 and 24 are rounded so that the mating surfaces of the bricks easily slip into place. This has other ramifications, as explained below.

For a brick 10 having a length of thirteen and one half inches and four and one half inches wide, three crosswise tongues 22 and grooves 24 can be provided, the spacing between the center lines of the crosswise tongues and grooves being about four and one half inches. Other crosswise configurations are possible, and bricks shorter than the one depicted in FIG. 1 may have less than three crosswise tongues and grooves, as per the bricks of FIGS. 6B, H and K, and more than three, as shown in FIG. 6D. Again, such bricks are used in those portions of a flue wall needed to accommodate items that occupy space that is less than or more than the length of rectangular brick 10, i.e., a brick may locate seams between longitudinally abutting bricks directly over or beneath another brick seam. To prevent this, bricks are sized in length to straddle such seams, as discussed hereinafter. All bricks, however, of the subject system have lengths and widths that are even fractions or multiples of brick 10 and of the locations of crosswise tongues and grooves 22 and 24. The thicknesses of the bricks are the same.

FIG. 6A of the drawings shows a brick of the invention employed in areas of a flue wall containing a circular refractory opening. To this end, the brick of 6A is provided with a rounded indent 25 sized to the circumference of the opening. The upper and lower faces of this brick have crosswise tongues and grooves located in the manner of the baffle and tie bricks discussed in detail hereinafter.

A single row of vertically disposed bricks 10 superposed one upon the other can be employed in constructing each of the flue walls 12, as shown somewhat schematically in FIG. 2 of the drawings, with certain of the bricks depicted in FIGS. 3 to 6 employed in certain flue locations presently to be explained. A ring furnace has two combustion chamber flues 26, hereinafter referred to as combustion chambers, located on opposed sides of a pit 28. The pit is sized to receive green carbon anodes 30 for baking. The anodes are stacked one upon another, as shown in FIG. 2, and in a single row (FIG. 7), and packing material 32 such as particulate coke is placed in pits about the anodes for physical support and to aid in transferring heat from the combustion chambers to the anodes, as the anode bodies are baked at high temperatures. Each combustion chamber is separated from longitudinally adjacent chambers by a headwall 33, as seen in the plan view of FIG. 7.

Combustion chambers 26 conduct hot gaseous products past the pit walls for the baking process, and baffle bricks 34 and 36 (FIG. 3) are located in the flues to insure a proper dwell time of the gaseous flow, as the flow would otherwise "short circuit" to connecting passages between adjacent flues. This is because a ring furnace comprises multiple physically parallel flues and pits which allow successive anode placement in and removal from the multiple pits, with hot gases flowing through serially connected flues of the pits currently containing anodes. The firing is thus serial and sequential, and the term "ring furnace" refers simply to the process of how the flues are fired, i.e., the firing of the flues moves around a furnace in a circular pattern. Combusted flue gases are collected in duct work and transported to a fume collection system before being exhausted into the outside atmosphere.

FIG. 3 of the drawings shows a brick 34 employed to construct baffles (not otherwise shown) in combustion chambers 26 and to simultaneously tie the two flue walls 12 together. A second independent tie brick 35 is shown in FIG. 6G of the drawings for also tying the walls. Bricks 34 and 35 tie walls 12 of the flues together to further stabilize the flue walls. As best seen in FIG. 5, brick 34 has a segmented longitudinal tongue comprised of an intermediate portion 14*a* and short end portions 14*b* that terminate short of the ends of the brick, while cross tongues 22*a* near the ends of the brick extend to the sides of the brick. In the upper face of the brick in FIG. 3, a longitudinal groove 18*a* also terminates short of the brick ends while crosswise grooves 24*a* near the brick ends extend to the sides of the brick. Bricks 34, in combination with filler bricks 36 in FIG. 3, provide a solid baffle structure in a combustion chamber 26 that assists in directing combustion gas down into the flues. The lower end of the baffle wall stops short of the flue bottom so that the gas passes beneath the baffle and rises to the upper portion of the flue on the other side of the baffle wall. The filler bricks 36 abut inner flue wall surfaces in forming the solid baffle but do not "tie" the flue walls. An independent view of the filler brick is presented in FIG. 6J.

Further, in FIG. 4, the bricks that form wall 12 are of different lengths such that brick seams are longitudinally offset. For example, the uppermost bricks 10 can be longer than the bricks of the next lower course so that their seams will be longitudinally offset, see the bricks of FIGS. 6C and 6D. Similarly, ledge bricks 37 (discussed in detail below) can be shorter than the brick 10 immediately below brick 37. The tie brick 35, being, for example, only four and one half inches wide, requires bricks at each end thereof to be of a length that will longitudinally offset their seams from those of bricks 10 and 37 immediately above and below them. Short, intermediate, and long bricks of FIGS. 6B, C and D provide such offsets.

At locations between the baffles of bricks 34 and 36, flue walls 12 can be tied together by the independent tie bricks 35 of FIGS. 4 and 6G.

In constructing a flue wall 12, the tongue and groove configuration of brick 35 allows its crosswise tongues 22*a* to seat in the longitudinal groove 18 of a "ledge" brick 37, located immediately below tie brick 35, as seen in FIG. 4. Ledge brick 37 has the same configuration as brick 10 except for an integral extension 38 of one side of the brick, as best seen in FIG. 6F of the drawings. The extension can be centered on the one side, and as seen in FIG. 6F, extends partially into the area of flues 26 to engage and support the span of tie bricks 35.

As seen in FIG. 4, brick 35 extends crosswise of a ledge brick 37 and an upper main brick 10 to tie walls 12 of a flue together. All of the bricks in the system of the invention stack one upon the other to provide flue walls, ties and baffles. Main rectangular bricks 10 extend in the longitudinal direction of wall 12, with the longitudinal tongue 14 thereof seated in the longitudinal groove 24*a* of tie brick 35.

As seen in FIG. 2, the lower ends of flue walls 12 rest on general planar foundation 45. Between the upper surface of foundation 45 and the lowermost course of flue bricks 10 is a brick 46 that bridges the lowermost ends of combustion chambers 26. Bricks 46 have a planar bottom surface 47 that rests on a planar course of bricks 48, and an opposed face surface 20*c* provided with longitudinal grooves 18*c* and crosswise grooves 24*c*, as best seen in FIGS. 6E and H (6E and H have different lengths to, again, offset brick seams). The longitudinal grooves 18*c* extend the full length of bricks 46 for receiving the full extent of lengthwise tongues 14 of bricks 10. The crosswise grooves 24*c* of bricks 46 receive the crosswise tongues 22 of bricks 10. Crosswise grooves 24*c* do not extend to the edges of bricks 46 such that these grooves do not comprise the integrity of walls 12 or provide communication between anode pits 28 and chamber 26

FIG. 6K shows a brick for spanning the upper ends of flue walls 12; such upper bricks are again provided with different lengths to longitudinally offset brick seams.

Anodes 30 are heated and baked in pits 28 by hot gases flowing through combustion chambers 26. The hot gases are products of combustion in the flues. Fuel for combusion is supplied to the flues through openings 40 in upper caps 42 on walls 12 (FIG. 2) for mixing with air already present in the flues.

The integrity of walls 12 and 33 is important, as the heating gases must remain in and travel through combustion chambers 26, while packing material 32 in pits 28 must remain in the pits and about the anodes. The integrity of headwalls 33 is important in separating the pits, as all of the pits are not simultaneously fired and used. The loss of gases into the pits and the movement of packing into gaps between the bricks reduces heating efficiency.

Thus, the durability and strength of flue walls 12 is important, as any buckling, collapsing or separation of the wall removes that portion of the ring furnace from production and requires expensive repair to return the portion to the anode baking process.

Flue wall bricks expand during heat-up of the flues and pits, and contract when the flues cool. If the bricks do not settle back to a close fitting relationship after the expansion/contraction process, gaps form between adjoining bricks such that packing material 32 enters the gaps and is trapped between the bricks. After a period of time of expansion and contraction, the accumulation of packing material between the bricks eliminates clearance for brick expansion and thus pushes the bricks out into headwalls 33 causing walls 12 to buckle into pit areas 28.

These problems are largely solved by the bricks of the invention. The rounded surfaces of the tongues and grooves provide seating and mating surfaces that insure a stable wall structure by allowing adjoining bricks to ride up on each other when expansion of the bricks occurs during heating periods, and to settle back on each other when cooling occurs. Thus, the rounded surfaces do not have shear planes through which the bricks move during expanding and contracting. Shear planes provide stress points and opportunities for breakage with relative movement of the flue wall, cross tie and baffle bricks. Broken portions of brick material provide opportunities for lodging between adjoining bricks, which makes the brick walls unstable, and may allow fluid communication between the flue combustion chambers 26 and anode pits 28, depending upon the amount and extent of broken material available for location between the bricks.

In the present invention, the bricks settle back to the positions they occupied when walls 12 were constructed after expansion occurs and cooling begins. As a result, the entry of packing material 32 between the bricks is limited and broken pieces of brick material are generally not available for separating the bricks, thereby maintaining wall integrity and the separation of the combustion chamber and pit areas 26 and 28, respectively.

In addition, the brick configurations of the present invention provide a stability that allows flues to be constructed in a "dry" manner, then transported intact to empty furnace pits, and disposed intact in the empty pits.

What is claimed is:

1. A refractory heat resistant brick for use in constructing flue walls of a ring furnace, said brick having opposed sides and upper and lower surfaces when disposed in a vertical flue wall structure of said furnace, with one of said surfaces having an elongated groove extending lengthwise of the brick, and at least one additional groove extending crosswise of the surface, said crosswise groove terminating short of the sides of the brick, and an elongated tongue provided on the other of said surfaces and extending lengthwise of the brick, and at least one additional tongue extending crosswise of the surface but terminating short of the sides of the brick, said tongues and grooves having rounded configurations and sized to mate with bricks having the same tongue and groove configurations when a plurality of such bricks are stacked one upon the other in constructing the flue walls.

2. The brick of claim 1 in which the upper and lower surfaces have respectively at least two tongues and grooves spaced apart lengthwise of the brick and extending crosswise of said surfaces but terminating short of the sides of the brick.

3. In combination, a vertical flue wall of a ring furnace and superposed rows of longitudinally aligned refractory bricks having generally parallel opposed sides, ends and upper and lower parallel mating surfaces forming said flue wall, said mating surfaces having a groove provided in one of said surfaces and extending lengthwise of the surface, and at least one additional groove extending crosswise of said one surface but terminating short of the parallel sides of the brick, and a tongue provided on the other of said mating surfaces and extending lengthwise thereof, with at least one additional tongue extending crosswise of the surface but terminating short of the parallel sides of the brick, the tongues provided on one of said mating surfaces seating in the grooves of the other of said mating surfaces.

4. In combination, flue walls of a ring furnace and a refractory heat resistant brick for tying flue walls of a ring furnace together and for construction of a baffle in said flue walls, said brick having opposed sides, opposed ends and upper and lower surfaces when disposed in a vertical wall structure, with one of said surfaces having an elongated groove extending lengthwise of the brick but terminating short of the ends of the brick, and at least one additional groove extending crosswise of the surface and the elongated groove and to the sides of the brick, a segmented tongue provided on the other surface of the brick, said segmented tongue comprising an elongated intermediate tongue portion located between two relatively short tongue portions located in line with the elongated tongue portion but near the ends of the brick, and terminating short of said ends, and at least one additional tongue provided on said other surface that extends crosswise of the segmented tongue portions and to the opposed sides of the brick.

5. In combination, flue walls of a ring furnace and a refractory heat resistant brick for tying flue walls of a ring furnace together, said brick having opposed sides, opposed ends and upper and lower surfaces when disposed in a vertical flue wall structure with, one of said surfaces having at least one groove extending to the sides of the brick and another groove extending crosswise of the one groove and terminating short of the brick ends, and said other surface having at least one tongue that extends to the sides of the brick and another tongue extending crosswise of the one tongue but terminating short of the ends of the brick.

6. In combination, flue wall and a refractory heat resistant brick for supporting a refractory heat resistant tie brick in said flue wall, said supporting brick having opposed sides and upper and lower surfaces when disposed in a vertical wall structure, with one of said surfaces having an elongated groove extending lengthwise of the brick and at least one additional groove extending crosswise of the surface and elongated groove, said crosswise groove terminating short of the sides of the brick, an elongated tongue provided on the other surface and extending lengthwise of the brick, and at least one additional tongue extending crosswise of the surface and elongated tongue but terminating short of the sides of the brick, and an integral ledge portion of the brick extending from one of said opposed sides for location immediately beneath said refractory heat resistant tie brick when the supporting brick is located in a vertical wall of superposed refractory heat resistant bricks to support the span of the tie brick.

7. A refractory heat resistant brick system for constructing walls of a flue for a ring furnace, said system including:

a brick having opposed sides and upper and lower surfaces when disposed in a vertical flue wall structure of a ring furnace, with one of said surfaces having a groove extending lengthwise of the brick and at least one additional groove extending crosswise of the first groove, with one of said grooves extending to the sides of the brick and the other of said grooves terminating short of the sides of the brick, and an elongated tongue provided on the other of said surfaces and extending lengthwise of the brick, and at least one additional tongue extending crosswise of the surface, with one of said tongues extending to the sides of the brick while the other of said tongues terminates short of the sides of the brick, a first refractory heat resistant brick for tying flue walls of the ring furnace together and for construction of a baffle in said flue, said tie brick having a segmented tongue provided on one surface of the brick and comprising an elongated intermediate tongue portion located between two relatively short tongue portions located in line with the elongated tongue portion but located near the ends of the brick, and terminating short of said ends and, at least one additional tongue provided on the other surface that extends crosswise of the segmented tongue portion into the opposed sides of the brick, a second tie brick having opposed sides, opposed ends and upper and lower surfaces when disposed in said vertical flue wall structure, with one of said surfaces having a first groove extending to the sides of the brick and the second groove extending crosswise of the first groove but terminating short of the brick end, and said other surface having a first tongue that extends to the sides of the second tie brick and a second crosswise tongue terminating short of the ends of the second tie brick, a refractory heat resistant brick for supporting said second tie brick, said supporting brick having an integral ledge portion extending from one of opposed sides of the brick for location immediately beneath the tie brick when the supporting brick is located in a vertical wall of opposed refractory resistant brick to support the span of the tie brick, and filler bricks located above and below the first tie brick, and in engagement therewith, to create a baffle in the flue of said ring furnace.

* * * * *